US007118461B2

(12) United States Patent
West et al.

(10) Patent No.: US 7,118,461 B2
(45) Date of Patent: Oct. 10, 2006

(54) SMOOTH PADS FOR CMP AND POLISHING SUBSTRATES

(75) Inventors: Thomas E. West, Portolla Valley, CA (US); Guangwei Wu, Sunnyvale, CA (US); Donald P. Dietz, Mountain View, CA (US)

(73) Assignee: Thomas West Inc., Sunnyvale, CA (US)

( * ) Notice: Subject to any disclaimer, the term of this patent is extended or adjusted under 35 U.S.C. 154(b) by 36 days.

(21) Appl. No.: 10/397,069

(22) Filed: Mar. 24, 2003

(65) Prior Publication Data

US 2003/0181155 A1 Sep. 25, 2003

Related U.S. Application Data

(60) Provisional application No. 60/368,048, filed on Mar. 25, 2002, provisional application No. 60/368,049, filed on Mar. 25, 2002.

(51) Int. Cl.
*B24B 1/00* (2006.01)

(52) U.S. Cl. ..... 451/56; 451/443; 451/28

(58) Field of Classification Search ..... 451/28, 451/41, 56, 443, 287, 290
See application file for complete search history.

(56) References Cited

U.S. PATENT DOCUMENTS

| | | | | |
|---|---|---|---|---|
| 3,976,525 | A * | 8/1976 | Mednick | 156/72 |
| 5,486,131 | A * | 1/1996 | Cesna et al. | 451/56 |
| 6,089,965 | A * | 7/2000 | Otawa et al. | 451/527 |
| 6,582,283 | B1 * | 6/2003 | James et al. | 451/41 |
| 6,852,020 | B1 * | 2/2005 | Petroski et al. | 451/526 |

OTHER PUBLICATIONS

U.S. Appl. No. 60/340,819 Filing Date Oct. 29, 2001.
U.S. Appl. No. 60/340,962 Filing Date Oct. 29, 2001.
U.S. Appl. No. 10/020,082 Filing Date Dec. 11, 2001.
U.S. Appl. No. 10/020,081 Filing Date Dec. 11, 2001.
U.S. Appl. No. 60/368,048 Filing Date Mar. 25, 2002.
U.S. Appl. No. 60/368,049 Filing Date Mar. 25, 2002.
PCT International Search Report for International Application No. PCT/US03/09173. Date of mailing of international search report Aug. 8, 2003.

* cited by examiner

*Primary Examiner*—Eileen P. Morgan
(74) *Attorney, Agent, or Firm*—Larry Williams

(57) ABSTRACT

Pads and methods of making the pads for applications such as polishing substrates and chemical mechanical planarization of substrates are provided. The pads include a substantially smooth surface for improved performance.

8 Claims, No Drawings

SMOOTH PADS FOR CMP AND POLISHING SUBSTRATES

CROSS REFERENCE TO RELATED APPLICATIONS

This application claims benefit of U.S. application Ser. No. 60/368,048 filed Mar. 25, 2002 and U.S. application Ser. No. 60/368,049 filed Mar. 25, 2002. This application is related to U.S. patent application Ser. No. 10/020,081, filed Dec. 11, 2001, and U.S. patent application Ser. No. 10/020,082, filed Dec. 11, 2001. The contents of all of these applications are incorporated herein by this reference in their entirety.

TECHNICAL FIELD

This invention relates to pads for applications such as chemical mechanical planarization (CMP) and polishing of substrates such as semiconductor substrates, wafers, metallurgical samples, memory disk surfaces, optical components, lenses, and wafer masks. More particularly, the present invention relates to CMP pads and pads for polishing and methods of manufacturing pads having improved properties for fabrication of electronic devices.

BACKGROUND

Processes employing chemical mechanical planarization (CMP) or polishing techniques have been widely used to planarize the surface of wafers during the various stages of device fabrication in order to improve yield, performance, and reliability of the fabrication process. In fact, CMP has become essentially indispensable for the fabrication of advanced integrated circuits.

Integrated circuits are chemically and physically integrated into a substrate by patterning regions in the substrate and layers on the substrate. To achieve high yields, it is usually necessary to recreate a substantially flat substrate after processing steps that leave topographic features on the surface of the wafer, features such as surface irregularities, bumps, troughs, and trenches.

One type of commonly used pad for applications such as polishing and CMP of substrates is a felt pad. The felt pad is a composite of fibers impregnated with a resin. Felt pads offer many unique advantages compared to non-fiber pads like pure polyurethane pads. Some examples of the advantages are low cost of ownership and good non-uniformity for the CMP process. However, for some applications, felt pads may not be the ideal choice. Particularly, felt pads may not be able to provide optimum performance for applications such as those that require good planarization.

A need remains for improved polishing pads which provide effective planarization and improved planarization efficiency for substrates such as electronic device substrates. In addition, there is a need for new pads that can be used for longer periods of time before the pad must be replaced: in other words, pads having longer operational life for processes such as CMP.

SUMMARY

This invention pertains to improve pads for applications such as polishing substrates and CMP of substrates and related methods. The present invention seeks to overcome one or more of the deficiencies of the standard technologies for polishing and/or planarizing substrates.

One aspect of the invention is a pad for applications such as polishing substrates and CMP of substrates. An embodiment of the present invention is a pad for applications such as CMP of substrates for electronic device fabrication. In one embodiment, the pad includes a non-woven felt and a polymer resin. The felt is impregnated with the resin. The resin impregnated felt has a substantially smooth surface for contacting a substrate for processes such as polishing and CMP. In another embodiment, the pad comprises a pure polymer pad. The pure pad also has a substantially smooth surface for contacting a substrate for processes such as polishing and CMP.

Another aspect of the present invention is a method of making pads for applications such as CMP of substrates and polishing substrates.

It is to be understood that the invention is not limited in its application to the details of construction and to the arrangements of the components set forth in the following description or illustrated in the figures. The invention is capable of other embodiments and of being practiced and carried out in various ways. In addition, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out aspects of the present invention. It is important, therefore, that the claims be regarded as including such equivalent constructions insofar as they do not depart from the spirit and scope of the present invention.

Further, the purpose of the foregoing abstract is to enable the Patent Office and the public generally, and especially the scientists, engineers and practitioners in the art who are not familiar with patent or legal terms or phraseology, to determine quickly from a cursory inspection the nature and essence of the technical disclosure of the application. The abstract is not intended to define the invention of the application, which is measured by the claims, nor is the abstract intended to be limiting as to the scope of the invention in any way.

The above and still further features and advantages of the present invention will become apparent upon consideration of the following detailed descriptions of specific embodiments thereof.

DESCRIPTION

The operation of embodiments of the present invention will be discussed below, primarily, in the context of chemical mechanical planarization. However, it is to be understood that embodiments in accordance with the present invention may also be used for general applications of substrate polishing such as grinding, lapping, shaping and polishing of semiconductor substrates, wafers, metallurgical samples, memory disk surfaces, optical components, lenses, and wafer masks.

An embodiment of the present invention is an improved polishing pad for removing material from a substantially solid surface. More particularly, one embodiment of the present invention is a polishing pad for applications such as chemical mechanical planarization such as that used as part of integrated circuit manufacturing processes. Another embodiment of the present invention includes methods for performing chemical mechanical planarization.

Embodiments of the present invention include an improved polishing pad for applications such as chemical mechanical planarization. One embodiment of the present invention is a pad for chemical mechanical planarization of substrates for electronic device fabrication; the pad has a sufficiently smooth surface that is effective for planarization. In other words, pads according to embodiments of the present invention are capable of providing planarization efficiencies that are suitable for industrial processes such as chemical mechanical planarization. Preferably, the planarization efficiencies are high enough to meet the specifications for processing the work pieces.

Embodiments of the present invention will be presented in the following examples.

EXAMPLE 1

Various manufacturing techniques can be used to produce polishing pads according to embodiments of the present invention. In one embodiment, the polishing pad includes non-woven fibers comprising polyester and a polymer resin comprising polyurethane. Desirable properties for polishing pads according to embodiments of the present invention can be produced using polyester fibers having a denier of about 2. Those skilled in the art know that embodiments of the present invention can also be made using other deniers, such as for example, deniers in the range of about 1.5 to about 3.0.

Desirable properties for polishing pads according to embodiments of the present invention can be incorporated into the polishing pads by increasing the ratio of fiber to polymer resin in the polishing pad. For some embodiments of the present invention, the ratio of polyester fiber to polyurethane resin is in the range of from about 35:65 to about 65:35, and all ratios and ratio ranges subsumed therein. In other words, the polyester makes up from about 35% to about 65% and subranges subsumed therein. The polyurethane resin makes up from about 65% to about 35% and subranges subsumed therein. A preferred range is from 50:50 to about 65:35. Preferred embodiments of the present invention have ratios of polyester to polyurethane of about 55:45.

Some starting materials for embodiments of the present invention have a Shore D hardness from about 45 to about 65 and all subranges subsumed therein. A preferred embodiment has a Shore D hardness from about 47 to about 57 and all subranges subsumed therein. A more preferred embodiment has a Shore D hardness from about 51 to about 54.

Table 1 summarizes several physical properties of an example of starting materials for fabricating embodiments of the present invention. The pads according to some embodiments of the present invention will also have properties like those listed in Table 1 in addition to having a substantially smooth surface for CMP.

TABLE 1

| Property | Typical | Preferred |
|---|---|---|
| Pad Density gm/cc | 0.5–0.7 | 0.58 +/− 0.04 |
| Fiber to Polymer Resin Ratio | 35:65–65:35 | 55:45 |
| Hardness, Shore D | >47 | 51–54 |
| Hardness, Shore A | | 89–98 |
| Felt Density gm/cc | | 0.32 |
| Pore Size Range um | | 5–150 |
| Compressibility % | | 1.8 |
| Resiliency % | 70–100 | >80 |

Conventional methods were used for measuring the properties.

Embodiments of the present invention were produced by using starting material having properties substantially the same as those described in Table 1. A surface of the starting material was given a surface finish sufficiently smooth to allow effective planarization efficiency. For this particular example, the surface finish was produced by buffing the surface of the starting material with a 30 micrometer grit abrasive belt to remove an amount of material from the surface of the starting material. In this example, about 50 micrometers of material were removed from the surface. The surface was buffed with a 15 micrometer grit abrasive belt to remove an amount of material from the surface of the starting material. In this example, about 50 micrometers of material were removed from the surface. The buffed surface had a smooth surface finish suitable for use for planarizing work pieces. Example applications that the pad was suitable for use in include oxide and shallow trench isolation CMP and for copper metallization CMP.

The planarization capabilities of pads according to the invention presented in this example have been measured. In addition, similar measurements have been performed for pads having similar properties but without the smooth polishing surface. The experimental results, in general, show that pads according to this example embodiment of the invention have superior planarization capability over that of the pads without the smooth polishing surface. Specifically, embodiments of the present invention have increased planarization efficiency, decreased erosion, and decreased dishing for CMP processes.

One of the pads according to an embodiment of the present invention included a polyester felt impregnated with a polyurethane resin. The pad had a density of about 0.59 grams per cubic centimeter, a compressibility of about 1.8 percent, and a rebound of about 85 percent. The polishing surface of the pad had a surface finish produced by buffing the polishing surface of the pad so that the pad had a sufficient surface finish capable of providing effective planarization efficiency.

EXAMPLE 2

A method for fabricating a starting material for embodiments of the present invention includes providing a polymer sheet that has a non-woven felt impregnated with a thermoplastic polymer. The sheet has a density less than about 0.7 grams per cubic centimeter, and the sheet has a substrate contacting area. The method further includes the steps of heating the area a sufficient amount and contemporaneously applying a sufficient amount of mechanical pressure so that the density of the sheet increases to greater than about 0.7 grams per cubic centimeter. Polishing pads according to some embodiments of the present invention have densities in the range of from about 0.5 grams per cubic centimeter to about 1.2 grams per cubic centimeter.

Embodiments of the present invention have been used to produce a pad having a density of about 1.03 grams per cubic centimeter. The pad was made from a starting polymer sheet comprising a non-woven thermoplastic resin impregnated felt having a density of about 0.59 grams per cubic centimeter. During the process, the thickness of the sheet was decreased from an initial thickness of about 0.049 inches (1.24 mm) to a post-process thickness of about 0.027–0.028 inches (0.68–0.71 mm). The thickness decrease produced a substantially corresponding increase in the density of the polymer sheet. The hardness of the polymer sheet also increased. The pad fabricated from the sheet, after the heat and pressure processing, was more dense and harder than the starting polymer sheet.

In an embodiment of the present invention, pads can be produced from a polymer sheet having a nonwoven felt, such as a polyester, impregnated with a thermoplastic resin, such as a polyurethane. The starting polymer sheet had a Shore D hardness of about 50. The application of sufficient heat and pressure to the starting polymer sheet produced an increase in the hardness of the sheet to a Shore D hardness of about 60–62.

Some embodiments of the present invention have a Shore D hardness from about 50 to about 65 and all subranges subsumed therein. Preferably, pads made according to embodiments of the present invention have a Shore D hardness of at least about 60. Preferred embodiments have a Shore D hardness from about 60 to about 62 and all subranges subsumed therein.

A preferred starting material for embodiments of the present invention is a pad for CMP that includes a polymer composite having a non-woven felt of polymer fibers impregnated with a resin. To produce the pad, the polymer composite is subjected to heat and pressure so that the composite has a density greater than about 0.70 grams per cubic centimeter. In addition, the composite has a Shore D hardness of at least 60.

As indicated earlier, the process conditions for embodiments of the present invention will be determined in part by properties of the starting polymer sheet. The following example provides process conditions that have been used for fabricating starting materials for embodiments of the present invention. In this example, the polymer sheet includes a nonwoven felt of polymer fibers such as, for example, polyester fibers or nylon fibers. The felt is impregnated with a resin such as, for example, a thermoplastic polyurethane. The polymer sheet has dimensions of about 10.5 inches× 10.5 inches (about 267 mm×267 mm) and a thickness of about 0.05 inches (about 1.27 mm). The polymer sheet is placed between two substantially smooth steel surfaces. The steel surfaces are heated to about the selected processing temperature. Suitable processing temperatures for this example are in the range of from about 300 degrees F. (149 degree C.) to about 450 degrees F. (232 degree C.), including all temperatures and ranges of temperatures subsumed therein. Preferred temperatures are in the range of about 375 degrees F. (191 degree C.) to about 400 degrees F. (204 degrees C.), including all temperatures and ranges of temperatures subsumed therein.

Preferably, though it may not be required, the polymer sheet is allowed to contact the heated surfaces for a period of time so that the temperature of the polymer sheet increases to about the temperature for processing. In other words, the sheet may be preheated before application of the high pressure. In this example, the polymer sheet was allowed to heat for about 20 seconds. After heating, pressure was applied to the polymer sheet via the steel surfaces. Suitable pressures for embodiments of the present invention are pressures greater than about 1500 psi (10.3 megapascals). Preferably, the pressures are greater than about 2500 psi (17.2 megapascals). Some particularly good results were obtained using a processing pressure of about 2900 psi (20 megapascals).

For some of the experiments, a pressure of about 2900 psi (20 megapascals) was applied for a period of about 10 seconds. For other experiments using a pressure of about 2900 psi (20 megapascals), the pressure was applied for a period of about 10 seconds followed by a 180-degree rotation within the plane of the sheet and then followed by another application of pressure at 2900 psi (20 megapascals) for a period of about 10 seconds. The two-step pressure application resulted in greater uniformity of properties of the polymer sheet. It is to be understood that the equipment used for this experiment may not have been optimized for process uniformity and, therefore, should not be considered as a limitation for practicing the present invention.

Following the application of heat and pressure, the sheet was allowed to cool while sandwiched between two substantially flat plates of aluminum. The plates of aluminum were arranged to provide sufficient pressure to keep the polymer sheet substantially flat during at least part of the cooling step so as to prevent the formation of wrinkles or waves in the surface of the polymer sheet.

A polymer sheet having a thickness of about 0.050 inches (1.3 mm) was heated to a temperature in the range of about 375 degrees F. (191 degrees C.) to about 400 degrees F. (204 degrees C.). Pressure was applied to the heated polymer sheet until the polymer sheet was compressed to a predetermined thickness fixed by a physical stop having a thickness of about 0.020 inches (0.51 mm). After removal of the pressure and the heat, the polymer sheet had a thickness of about 0.030 inches (0.76 mm). It is to be stood that the starting thickness of the polymer sheet for this example is for purposes of illustration. Other thicknesses can be used for the starting material thickness.

For the previous example, heated plates were used for carrying out the processing steps. As known by those skilled in the art, an alternative would be to use heated rollers for applying the heat and pressure. In addition, other known techniques for heating and applying pressure can be used in embodiments of the present invention.

Embodiments of the present invention can be used to produce pads having substantially selectable porosity and density profiles through the thickness of the pad. In other words, by selecting the processing conditions of temperature, pressure, and time duration of their application, the porosity profile near the surface of the pad may differ from that of the profile away from the surface at locations near the middle of the thickness of the pad, i.e., the midpoint of the pad thickness. Optionally, heat may be applied to both sides of the starting polymer sheet or heat may be applied to only one side of the polymer sheet so as to achieve selectable density profiles through the thickness of the pad.

Table 2 summarizes several physical properties of starting materials for some embodiments of polishing pads according to the present invention. The pads according to some embodiments of the present invention will also have properties like those listed in TABLE 2 in addition to having a substantially smooth surface for CMP.

TABLE 2

| Property | Typical | Preferred |
|---|---|---|
| Pad Density gm/cc | 0.5–1.2 | about 1 |
| Fiber to Polymer Resin Ratio | 55:45 | |
| Hardness, Shore D | > about 50 | 60–62 |
| Felt Density gm/cc | | 0.32 |

Embodiments of the present invention can be produced by using starting material having properties substantially the same as those described in Table 2. A surface of the starting material can be given a surface finish sufficiently smooth to allow effective planarization or effective planarization efficiency. For this particular example, the surface finish can be produced by buffing the surface of the starting material with a 30 micrometer grit abrasive belt to remove an amount of material from the surface of the starting material. In this example, about 50 micrometers of material may be removed from the surface. The surface can be buffed with a 15 micrometer grit abrasive belt to remove an amount of material from the surface of the starting material. In this example, about 50 micrometers of material may be removed from the surface. The buffed surface is expected to have a smooth surface finish suitable for use for planarizing work pieces and have a higher planarization efficiency than may be possible without the smooth surface according to the present invention.

Specifically, one embodiment of the present invention is a pad, prepared according to the present disclosure, for CMP of a substrate for the purpose of forming at least one of: shallow trench isolation structures, interlayer dielectric structures, intermetal dielectric structures, and copper metallization structures.

EXAMPLE 3

Various types of pads have been developed in efforts to meet the needs of CMP processes and polishing processes. For a more detailed discussion of representative types of pads see PCT application W096/15887, the specification of which is incorporated herein by reference. Other representative examples of pads and methods of their fabrication are described in U.S. patents U.S. Pat. No. 4,511,605, U.S. Pat. No. 4,708,891, U.S. Pat. No. 4,728,552, U.S. Pat. No. 4,841,680, U.S. Pat. No. 4,927,432, U.S. Pat. No. 5,533,923, U.S. Pat. No. 6,126,532, U.S. Pat. No. 6,231,434, and U.S. Pat. No. 6,287,185, the specifications of which are also each incorporated herein in their entirety by this reference. Pads according to the present invention can be fabricated using the methods and starting materials described in the previously listed patents and patent applications. The polishing surfaces of those pads can be given a surface finish according to the methods disclosed herein for embodiments of the present invention so as to produce pads having a higher planarization efficiency than is obtainable without the smooth polishing surface.

EXAMPLE 4

Surface Roughness parameters where measured for an embodiment of the present invention for embodiments of starting materials that may be suitable starting materials for an embodiment of the present invention. The measurements were made according to the DIN 4776 Standard (German Institute for Standardization).

The following are definitions of measurement parameter notations:

- Rk—Core Roughness Depth—Depth of the roughness core profile.
- Rpk—Reduced peak height—Average height of protruding peaks above the core profile.
- Rvk—Reduced valley depth—Average depth of the profile valleys projecting thorough the roughness core profile.
- Mr1—Material Portion Mr1.
- Mr2—Material Portion Mr2.

Surface roughness parameters were measured for a pad fabricated according to the method of Example 1, supra. The measurement values for this embodiment of the present invention were Rk from about 2 to about 15, Rpk from about 0.5 to about 5, Rvk from about 8 to about 20, Mr1 from about 1 to about 8, and Mr2 from about 68 to about 78. It is to be understood that the measured parameters are provided merely as an illustration for one example of an embodiment of the present invention; other embodiments may have surface roughness parameters different than those of the present example.

For comparison, surface roughness parameters were also measured for the starting material for the pad prior to the surface smoothing steps of Example 1. The starting material is suitable for making a hard porous pad with properties like those presented in Table 1. The measurement values for the starting material were Rk from about 25 to about 35, Rpk from about 8 to about 15, Rvk from about 12 to about 25, Mr1 from about 7 to about 12, and Mr2 from about 82 to about 92.

Further, surface parameter measurements were made for another material that may be suitable as a starting material for a process as described in Example 1, supra. This starting material is more porous than the previous starting material. The measurement values for the starting material were Rk from about 35 to about 45, Rpk from about 10 to about 20, Rvk from about 20 to about 30, Mr1 from about 7 to about 12, and Mr2 from about 80 to about 90.

It is to be understood that the examples given in the present application are merely exemplary. They are not intended as limitations of the present invention. In view of the present disclosure, those of ordinary skill in the art will recognize other methods for producing a polishing surface for the pads so that the pads have a sufficient surface finish for improved planarization efficiency.

Additional embodiments of the present invention will be present next. The first set of embodiments is for pads according to the present invention. One embodiment of the present invention includes a pad for CMP comprising a composite of polymer fibers impregnated with a resin. The composite has a smooth surface wherein the surface finish of the smooth surface is capable of effective planarization. Preferably, the surface finish of the smooth surface is substantially the same as that of abrading the composite with an abrasive having particle grits greater than 200. Some of the more preferred embodiments of the pad have a Shore D hardness greater than about 45. Optionally, some preferred embodiments of the present invention have a density greater than about 0.5 grams per cubic centimeter.

Another embodiment of the present invention comprises a pad that includes polymer fibers that comprise a non-woven felt of polymer fibers; the composite has a smooth surface for use in chemical mechanical planarization and polishing substrates wherein the surface finish of the smooth surface is substantially the same as that of abrading the composite with an abrasive having particle grits greater than 200.

A pad according to one embodiment of the present invention includes a non-woven felt of polymer fibers impregnated with a resin so as to form a composite. The composite has a smooth surface for use in chemical mechanical planarization and polishing substrates wherein the surface finish of the smooth surface is substantially the same as that of abrading the composite with an abrasive having particle sizes in the range of about 1 micrometer to about 50 micrometers and all ranges subsumed therein. Preferably, the pad has a Shore D hardness greater than about 45 and a density greater than about 0.5 grams per cubic centimeter. For some applications, a more preferred embodiment has a density greater than about 0.70 grams per cubic centimeter and a Shore D hardness of at least 50 and more preferably a Shore D hardness greater than about 60.

In another embodiment of the present invention, the surface finish of the smooth surface is substantially the same as that of abrading the composite with an abrasive having particle grits greater than 300.

Another embodiment of the present invention includes a pad for chemical mechanical planarization of substrates for electronic device fabrication, the pad comprising: a non-woven felt comprising polyester fibers, the felt having a denier of about 2, the felt having a density of about 0.32+/−0.03 grams per cubic centimeter; a polymer resin comprising polyurethane, the resin having a 100% modulus value of about 300 kg/cm to about 400 kg/cm; wherein, the felt is impregnated with the resin so that the pad has a density greater than about 0.5 grams per cubic centimeter, a polyurethane to fiber ratio of about 45:55, a compressive modulus greater than about 70%, a substantially homogeneous, substantially open pore structure sufficient for transporting amounts of a polishing slurry effective for CMP; and the pad having a substantially smooth surface wherein the surface finish of the smooth surface is substantially the same as that of abrading the composite with an abrasive having particle sizes in the range of about 1 micrometer to about 50 micrometers and all ranges subsumed therein.

In one embodiment, the pad has an air permeability greater than about 20 (cubic centimeters)/((square centimeter)(minute)). In a preferred embodiment, the pad has an air permeability in the range of about 24 to about 34 (cubic centimeters)/((square centimeter)(minute)). For some embodiments of the present invention, the resin has a 100% modulus value of about 350 kg/cm, the ratio of weight percent fiber to weight percent resin is about 55:45, the felt comprises polyester, and the resin comprises polyurethane.

Another embodiment of the present invention includes a non-woven felt of polymer fibers, the felt having a density greater than about 0.29 grams per cubic centimeter and a resin. The felt and resin are combined so as to form a composite of felt and resin wherein the ratio of weight percent fiber to weight percent resin is in the range from about 50:50 to about 65:35. The pad has a sufficiently smooth surface so as to be capable of providing effective planarization for CMP processes. Preferably, the pad has a density greater than about 0.5 grams per cubic centimeter. In one embodiment, the surface finish of the smooth surface is substantially the same as that of abrading the composite with an abrasive having particle grits greater than 200. In another embodiment, the surface finish of the smooth surface is substantially the same as that of abrading the composite with an abrasive having particle grits greater than 300.

Embodiments of the present invention may also include a pad comprising a substantially pure resin, the pad having a smooth surface for chemical mechanical planarization wherein the surface finish of the smooth surface is substantially the same as that of abrading the resin with an abrasive having particle grits greater than 200, more preferably, particle grits greater than 300.

Another embodiment includes a pad comprising a substantially pure resin. The pad has a smooth surface for chemical mechanical planarization wherein the surface finish of the smooth surface is substantially the same as that of abrading the resin with an abrasive having particle sizes in the range of about 1 micrometer to about 50 micrometers and all ranges subsumed therein. Preferably, the particles are bonded to a carrier and the nearest neighbor distance between the particles is less than about 4 times the average size of the particles.

The following are methods of making pads according to embodiments of the present invention. One embodiment includes a method of making a pad for chemical mechanical planarization. The method includes the steps of providing a composite of non-woven felt of polymer fibers impregnated with a resin. The method further includes smoothing a surface on the composite so as to obtain a surface finish substantially the same as that of abrading the composite with an abrasive having particle grits greater than 300. Preferably, the smoothing step comprises abrading the composite.

Optionally, the smoothing step may comprise abrading the composite with abrasive particles. In one embodiment, the abrasive particles are bonded to a carrier. Preferably, the particles are bonded to the carrier so that the average nearest neighbor distance between the particles is less than or about equal to the average diameter of the fibers in the pad.

The method for some embodiments of the present invention may be performed using a variety of types of abrasive particles. Examples of some of the suitable types of particles are diamond particles, aluminum oxide particles, silicon carbide particles, and zirconia particles.

Preferably, the smoothing step is continued until the surface finish of the composite is capable of providing a predetermined or optimum planarization efficiency. In one embodiment of the method, the smoothing step comprises abrading with abrasive particles having an average size of about 30 micrometers followed by abrading with abrasive particles having an average size of about 15 micrometers.

In one embodiment, the smoothing step comprises removing about 50 micrometers of material from the surface of the composite using abrasive particles having an average size of about 30 microns. This is followed by removing about 50 micrometers from the surface of the composite using abrasive particles having an average size of about 15 micrometers.

In an alternative embodiment of the present invention, the smoothing step comprises applying heat or applying heat and pressure to the surface of the composite.

Another embodiment of the present invention includes a method of making a pad having a density of about 0.5 grams per cubic centimeter to about 0.7 grams per cubic centimeter. The method includes the steps of providing a non-woven felt of polymer fibers, the felt having a density greater than about 0.29 grams per cubic centimeter and providing a resin. The method also includes the step of impregnating the felt with the resin so as to form a composite of felt and resin wherein the ratio of weight percent fiber to weight percent resin is in the range from about 50:50 to about 65:35. The method further includes the step of smoothing a surface on the composite so as to obtain a surface finish substantially the same as that of abrading the composite with an abrasive having particle grits greater than 300. In preferred embodiments, the smoothing step is continued until the surface finish of the composite is capable of providing an effective planarization efficiency. More specifically, the smoothing step is continued until the surface finish of the composite is capable of providing a predetermined or optimum planarization efficiency for a CMP process.

In one embodiment of the present invention, the smoothing step comprises abrading with particles having sizes in the range of about 1 micrometer to about 50 micrometers and all ranges subsumed therein. In one embodiment, the particles are bonded to a carrier and the nearest neighbor distance between the particles is less than about 4 times the average size of the particles. In another embodiment, the nearest neighbor distance between the particles is less than about 2 times the average size of the particles. In yet another embodiment, the particles are bonded to a carrier such as a belt or a disk and the nearest neighbor distance between the particles is less than about the average size of the particles.

Another embodiment of the present invention includes a pad for CMP or polishing a substrate, the pad comprising a polymer sheet having a polishing surface wherein the polishing surface has surface roughness measurements of at least one of Rk less than about 25, Rpk less than about 8, Rvk less than about 12, Mr1 less than about 7, and Mr2 less than about 80. Optionally, the polymer sheet comprises polymer fibers impregnated with a resin. In a further embodiment, the polymer sheet comprises a mass of non-woven polymer fibers impregnated with a resin.

A pad for CMP or polishing a substrate, the pad comprising a polymer sheet having a polishing surface wherein the polishing surface has surface roughness measurements of at least one of Rk less than about 15, Rpk not greater than about 5, Rvk not greater than about 12, Mr1 not greater than about 7, and Mr2 not greater than about 78.

A pad for CMP or polishing a substrate, the pad comprising a polymer sheet having a polishing surface wherein the polishing surface has surface roughness measurements of at least one of Rk from about 2 to about 15, Rpk from about 0.5 to about 5, Rvk from about 8 to less than about 12, Mr1 from about 1 less than about 7, and Mr2 from about 68 to about 78. Optionally, the polymer sheet comprises polymer fibers impregnated with a resin. Optionally, the polymer sheet comprises a mass of nonwoven polymer fibers impregnated with a resin. Optionally, the polymer sheet comprises a pure polymer substantially without fibers.

A wide range of polymer resins may be used in embodiments of the present invention. Suitable resins include resins such as, for example, polyvinylchloride, polyvinylfluoride, nylons, fluorocarbons, polycarbonate, polyester, polyacrylate, polyether, polyethylene, polyamide, polyurethane, polystyrene, polypropylene, and mixtures thereof. The selection of the resin will depend upon the desired properties of the pad. Preferred embodiments of the present invention include resins that have high hardness values. This means that for resin impregnated felt pads according to preferred embodiments of the present invention, the hardness of the resin is higher than that of resins that are typically used for resin impregnated felt pads according to the standard technology. Typical resins are commercially available from a number of vendors.

While there have been described and illustrated specific embodiments of the invention, it will be clear that variations in the details of the embodiments specifically illustrated and described may be made without departing from the true spirit and scope of the invention as defined in the appended claims and their legal equivalents.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," "includes," "including," "has," "having," "at least one of," or any other variation thereof, are intended to cover a non-exclusive inclusion. For example, a process, method, article, or apparatus that comprises a list of elements is not necessarily limited only to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A method of making a pad for chemical mechanical planarization of a substrate, the method comprising the steps of:

providing a composite of non-woven felt of polymer fibers impregnated with a resin; and generating a smooth surface on the composite so that the smooth surface has a surface finish substantially equal to a surface finish that results from polishing the composite with an abrasive having particle grit sizes greater than 300, wherein the step of generating the smooth surface comprises removing about 50 micrometers from the surface of the composite using abrasive particles having an average size of about 30 micrometers followed by removing about 50 micrometers from the surface of the composite using abrasive particles having an average size of about 15 micrometers.

2. A method of making a pad, the pad having a density of about 0.5 grams per cubic centimeter to about 0.7 grams per cubic centimeter, the method comprising the steps of:

providing a non-woven felt of polymer fibers, the felt having a density greater than about 0.29 grams per cubic centimeter;

providing a resin;

impregnating the felt with the resin so as to form a composite of felt and resin wherein the ratio of weight percent fiber to weight percent resin is in the range from about 35:65 to about 65:35; and generating a smooth surface on the composite so that the smooth surface has a surface finish substantially equal to the surface finish produced by polishing the composite with abrasive particles less than 50 micrometers in size.

3. The method of claim 2, wherein the step of generating the smooth surface comprises abrading the composite.

4. The method of claim 2, wherein the step of generating the smooth surface is continued until the surface finish of the composite is capable of providing a predetermined or optimum planarization efficiency for chemical mechanical planarization of a substrate for an electronic device.

5. The method of claim 2, wherein the resin has a 100% modulus value of about 300 kg/cm to about 400 kg/cm.

6. The method of claim 2, wherein the ratio of weight percent fiber to weight percent resin is about 55:45.

7. The method of claim 2, wherein the smoothing step comprises abrading with particles having sizes less than 30 micrometers.

8. The method of claim 2, wherein the step of generating the smooth surface comprises abrading with particles having sizes in the range of about 1 micrometer to less than 50 micrometers and all ranges subsumed therein.

* * * * *